US006126522A

United States Patent [19]

Endo et al.

[11] Patent Number: 6,126,522

[45] **Date of Patent: *Oct. 3, 2000**

[54] METHOD FOR MANUFACTURING GOLF BALL

[75] Inventors: Seiichiro Endo; Masatoshi Yokota, both of Shirakawa; Masaaki Kikuchi, Akashi, all of Japan

[73] Assignee: Sumitomo Rubber Industries, Ltd., Kobe, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/794,738

[22] Filed: Feb. 3, 1997

Related U.S. Application Data

[63] Continuation-in-part of application No. 08/641,759, May 2, 1996, abandoned.

[30] Foreign Application Priority Data

May 12, 1995 [JP] Japan ..... 7-138760

[51] Int. Cl.[7] ..... B24B 1/00

[52] U.S. Cl. ..... 451/50; 451/242; 451/246; 451/456

[58] Field of Search ..... 451/49, 50, 242, 451/246, 247, 254, 456

[56] References Cited

U.S. PATENT DOCUMENTS

| | | | |
|---|---|---|---|
| 3,133,382 | 5/1964 | Messerschmidt | 451/50 |
| 3,640,028 | 2/1972 | Richard | 451/50 |
| 4,525,955 | 7/1985 | Cothrell et al. | 451/456 |
| 4,779,387 | 10/1988 | Reid et al. | 451/49 |
| 4,894,958 | 1/1990 | Takahashi | 451/247 |
| 5,439,412 | 8/1995 | Bishop | 451/49 |
| 5,472,330 | 12/1995 | Oka et al. | 451/398 |

FOREIGN PATENT DOCUMENTS

| | | |
|---|---|---|
| 60-232861 | 11/1985 | Japan . |
| 63-174801 | 7/1988 | Japan . |

*Primary Examiner*—Eileen P. Morgan
*Attorney, Agent, or Firm*—Armstrong,Westerman, Hattori, McLeland & Naughton

[57] ABSTRACT

A method for manufacturing a golf ball, wherein a grinding tool and a ball to be ground are rotated so that their adjacent points move toward opposite directions. A grinding face of the grinding tool is arranged to be Japanese Industrial Standard grain size #80 to 300. The ball is rotated at 100 to 600 mm/s and the grinding tool is rotated at 2400 to 6900 mm/s, and relative velocity of the grinding tool and the ball is 2500 to 7500 mm/s. Flash formed on a parting line of the ball is thereby removed by the grinding face of the rotating grinding tool.

2 Claims, 2 Drawing Sheets

METHOD FOR MANUFACTURING GOLF BALL

This is a CIP of 08/641,759 filed May 2, 1996, now abandoned.

BACKGROUND OF THE INVENTION

1. Field of the Invention

This invention relates to a method for manufacturing a golf ball.

2. Description of the Related Art

When a golf ball is manufactured by injection molding or compression molding, flash is formed on a parting line of the cover material, and it is necessary to remove the flash.

This flash has been conventionally removed by buffing the parting line of the cover material. To be specific, as described in Japanese Patent Provisional Publication No. 60-232861 and Japanese Patent Provisional Publication No. 63-174801, a golf ball is held between vertically arranged holding devices, the golf ball is rotated, an equatorial position (a parting line) of the golf ball is contacted by a grindstone or a cutting tool, and flash is removed from the golf ball. In the conventional method, the golf ball and the grindstone are respectively rotated at high speeds. For example, the grindstone is rotated at an extremely high speed of at least 10,000 mm/s.

Hard ionomer resin having bending rigidity of 2800 $Kg/cm^2$ to 4000 $Kg/cm^2$ has been conventionally used as cover material of golf balls, however, golf balls recently produced tend to be soft, and cover material for such balls also tends to be soft accordingly.

When a grinding apparatus (which is provided with the foregoing grindstone that rotates at a high speed) for hard cover material is used to buff the soft cover material, a face buffed by the apparatus becomes rough and buffing depths vary owing to differences in ball positioning and ball diameter, and it is not possible to beautifully finish a ball surface.

Moreover, the cover material is soft thermoplastics resin; therefore, ball shavings melt due to friction heat in buffing and stick to the ball surface.

It is therefore an object of the present invention to provide a method for manufacturing a golf ball in which a golf ball, buffed (ground) approximately uniformly in depth with an excellent external appearance, is manufactured.

BRIEF DESCRIPTION OF THE DRAWINGS

The present invention will be described with reference to the accompanying drawings, in which.

DESCRIPTION OF THE PREFERRED EMBODIMENTS

Preferred embodiments of the present invention will now be described with reference to the accompanying drawings.

Figure 1:
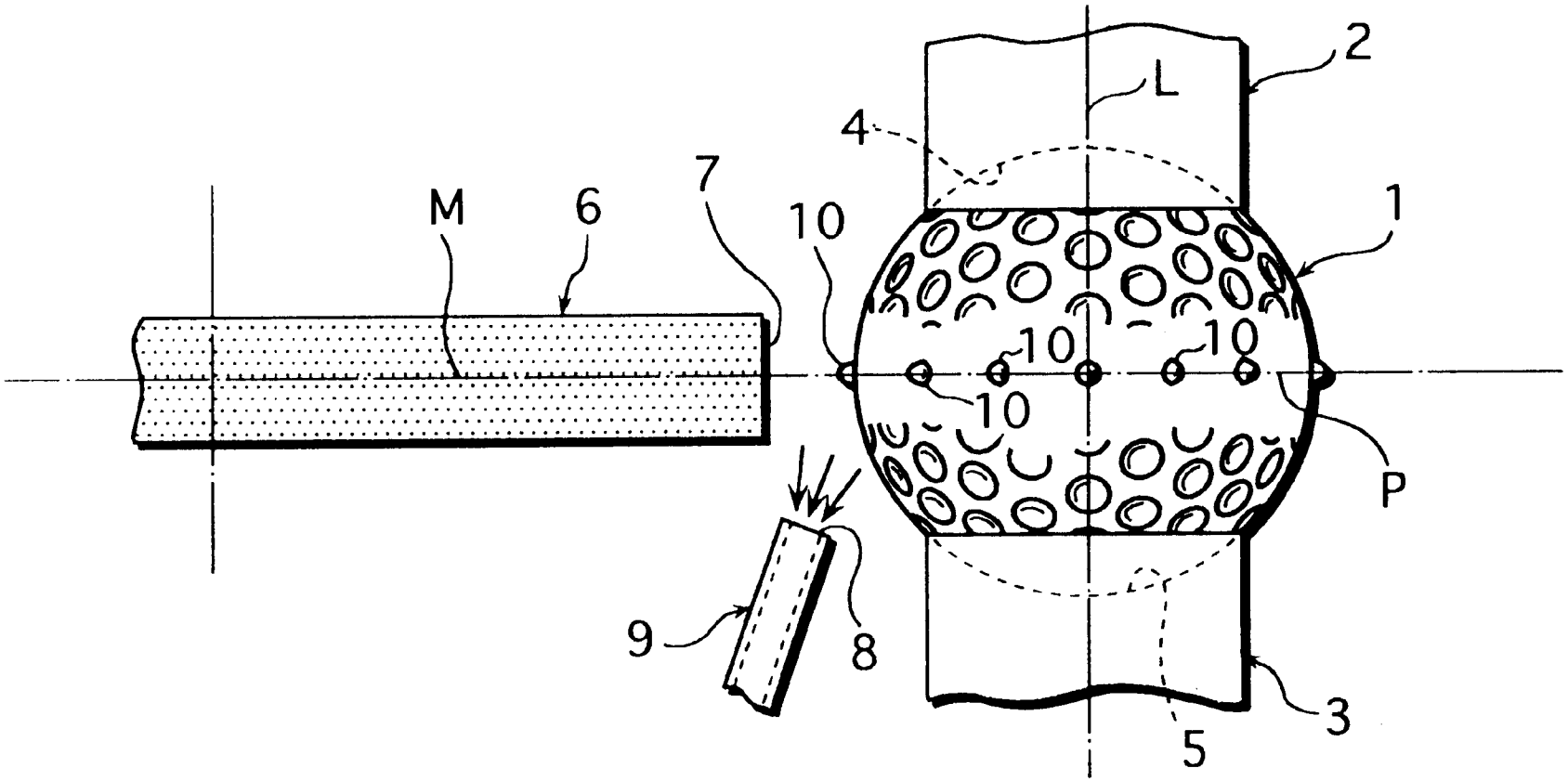
FIG. 1 is a schematic view in section of a grinding apparatus which is used in a method for manufacturing a golf ball according to the present invention.

FIG. 1 shows a grinding apparatus which is used in a method for manufacturing a golf ball according to the present invention. This apparatus is provided with a pair of vertically arranged supporting bodies 2, 3 for supporting an injection molded or compression molded golf ball 1 (a ball to be ground) covered with thermoplastics resin so that the equator of the golf ball 1, i.e. a parting line P having flash 10, coincides with a horizontal plane. The pair of supporting bodies 2, 3 rotate the ball 1 on an axis L (a vertical axis) of the ball 1. That is to say, the supporting bodies 2, 3 are provided with depressions 4, 5 on faces facing the ball 1, and a part of the ball 1 is fitted in each depression 4, 5. One of the supporting bodies 2, 3 is rotated by a rotation driving means (for example, a means provided with a driving motor—not shown in the drawings) on an axis of the supporting body (which axis coincides with the axis L of the ball 1) in a direction indicated by arrow B shown in FIG. 2, and the other supporting body freely rotates on an axis of the supporting body (which axis coincides with the axis L of the ball 1).

Figure 2:
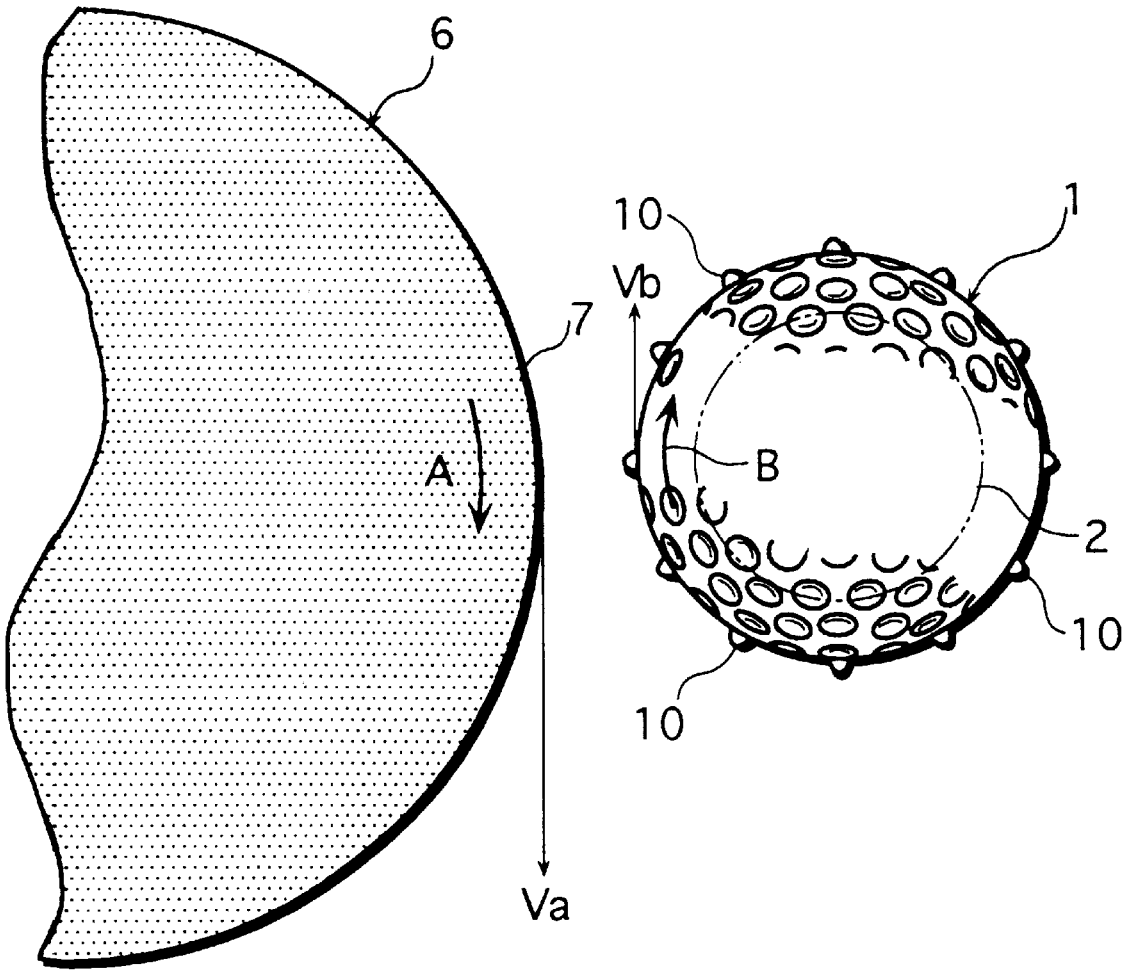
FIG. 2 is a schematic plan view showing the relation between a golf ball and a grinding tool.

A discoid grinding tool 6 is arranged near the supporting bodies 2, 3 A driving mechanism (for example, a mechanism provided with a driving motor—not shown in the attached drawings) rotates the grinding tool 6 on its axis in the direction of arrow A in FIG. 2.

An outer circumferential face of the grinding tool 6 is arranged to be a grinding plane 7 and, as shown in FIG. 1, a face M in the middle of the width direction of the grinding tool 6 coincides with the horizontal plane including the parting line P of the ball 1 supported by the supporting bodies 2, 3. The grinding tool 6 freely approaches and parts from the ball 1 keeping the middle plane M coincident with the horizontal plane owing to a driving means (for example, a cylinder mechanism or a mechanism provided with a threaded shaft and a nut member which fits with the threaded shaft—not shown in the attached drawings).

A sucking pipe 9 is arranged near the supporting bodies 2, 3, and is provided with a sucking mouth 8 which opens near the parting line P of the ball 1. The sucking pipe 9 is connected with an aspirator, not shown in the attached drawings, and air near the sucking mouth 8 is sucked through the sucking mouth 8 into the sucking pipe 9 by driving the aspirator.

Next, explained below is a method for manufacturing a golf ball using the grinding apparatus composed as described in the foregoing.

First, a ball 1 with flash 10 formed along a parting line P of the ball 1 is supported by the supporting bodies 2, 3 so that the parting line P coincides with the middle plane M of the grinding tool 6.

Next, the supporting bodies 2, 3 rotate the ball 1 on an axis L of the ball 1 in the direction indicated by the arrow B (see FIG. 2). In this case, the ball i is arranged to rotate at a circumferential speed of 100 mm/s to 600 mm/s.

The grinding tool 6 is rotated on an axis of the grinding tool 6 in the direction indicated by the arrow A (see FIG. 2). In this case, the grinding tool 6 is arranged to rotate at a circumferential speed of 2400 mm/s to 6900 mm/s.

Therefore, the grinding tool 6 and the ball 1 rotate so that their adjacent points move in opposite directions. (In FIG. 2, both of the grinding tool 6 and the ball 1 rotate clockwise so that the relative circumferential velocity becomes 2500 mm/s–7500 mm/s). Relative velocity herein described is a value obtained by simply adding a speed of the grinding tool 6 and a speed of the ball 1. In other words, when the grinding tool 6 rotates at a speed of Va and the ball 1 rotates at a speed of Vb, relative velocity Vc is expressed as follows:

$$Vc=Va+Vb$$

To be specific, if the grinding tool 6 rotates at 4000 mm/s and the ball 1 rotates at 300 mm/s, relative velocity is 4300 mm/s.

Velocity and directions of rotation of the ball 1 and the grinding tool 6 are arranged as described above, the grinding tool 6 is moved toward the ball 1, and the flash 10 of the ball 1 is removed by the grinding face 7 of the grinding tool 6.

At this time, the aspirator is driving to suck ball shavings from the sucking mouth 8.

Cover material of the ball 1 to be ground consists of thermoplastics resin having a hardness of Shore D 40 to 75 (for example, ionomer resin).

Grinding time is 0.3 to 5 seconds, and the ball 1 is caused to make at least two rotation within this grinding time.

It is preferable to use a diamond grindstone as the grinding tool 6; however, it is possible to use other kinds of grindstones, and moreover, it can be a belt sander.

Next, Table 1 shows test results of examining external appearances of golf balls manufactured by the method for manufacturing a golf ball according to the present invention.

In case of balls of ①' relative velocity is 7800 mm/s, and Uniformness in Seam Depth is x, which means that the buffed faces were ragged. Moreover, shavings were not sucked in the case of the balls of ①', therefore shavings stuck to twenty three balls out of one hundred.

In case of balls of ②', relative velocity is 2300 mm/s, therefore the column of Appearance of Buffed Face is x, which means that flash 10 could not be removed precisely. In case of balls of ③', relative velocity 2300 mm/s as well as in the case of the balls of ②', and flash 10 could not be removed precisely.

In case of balls of ④', the grain size of the grinding face is #60, therefore the column of Appearance of Buffed Face is xx, which means that the buffed faces were rough. In case of balls of ⑤', the grain size is #400 and grinding operation is difficult, consequently the buffed faces were not beautiful and the seam faces were ragged.

TABLE 1

| | Hardness of Cover Material | Grinding Tool Grain Size | Speed of Ball (mm/s) | Speed of Grinding Tool (mm/s) | Relative Velocity (mm/s) | Grinding Time (sec) | Appearance of Buffed Face | Uniformness in Seam Depth | Attachment of Shavings |
|---|---|---|---|---|---|---|---|---|---|
| ① | 56 | 120 | 300 | 3500 | 3800 | 1.2 | ◎ | ◎ | 0 |
| ② | 56 | 120 | 300 | 2400 | 2700 | 1.2 | ◎ | ◎ | 0 |
| ③ | 56 | 120 | 150 | 2400 | 2550 | 3.0 | ◎ | ◎ | 0 |
| ④ | 56 | 120 | 500 | 4400 | 4900 | 1.2 | ◎ | ◎ | 0 |
| ⑤ | 56 | 120 | 300 | 6000 | 6300 | 1.2 | ◎ | ◎ | 0 |
| ⑥ | 56 | 300 | 300 | 4000 | 4300 | 1.2 | ◎ | ◎ | 0 |
| ⑦ | 56 | 120 | 300 | 4000 | 4300 | 1.2 | ◎ | ◎ | 0 |
| ①' | 56 | 120 | 300 | 7500 | 7800 | 1.2 | ◎ | X | 23 |
| ②' | 56 | 120 | 300 | 2000 | 2300 | 1.2 | X | ◎ | 0 |
| ③' | 56 | 80 | 300 | 2000 | 2300 | 2.0 | X | ◎ | 0 |
| ④' | 56 | 60 | 300 | 4000 | 4300 | 1.2 | X | ◎ | 0 |
| ⑤' | 56 | 400 | 300 | 4000 | 4300 | 1.2 | X | X | 0 |

First, as shown in Table 1, balls with cover material having hardness of Shore D 56 (balls ①; to ⑥ in Table 1) and balls with cover material having hardness of Shore D 67 (balls of ⑦ are molded. Naturally, flash 10 is formed along parting lines P of the balls of ① to ⑦ before grinding the balls. Each ball was ground and flash was removed under conditions shown in Table 1. In each case of ① to ⑦, one hundred balls were ground, and ball shavings were sucked while the balls were ground. In the columns of Appearance of Buffed Face in Table 1, ◎ shows that the buffed face (ground face) is beautifully finished, and x shows that the grinded face is not beautiful (flash is not removed precisely). In the columns of Uniformness in Seam (on a parting line) Depth, ◎ shows that the buffed face is uniformly ground and x shows that the buffed face is ragged. The columns of Attachment of Shavings indicate numbers of balls on which molten shavings stuck.

As for the balls of ① to ⑦ (manufactured by the method for manufacturing a golf ball according to the present invention), the columns of Appearance of Buffed Face are all ◎, which means that their buffed faces were finished beautifully, the columns of Uniformness in Seam Depth are also all ◎, which means that the buffed faces were ground uniformly, and the columns of Attachment of Shavings are all 0, which means that shavings did not stick to the balls.

①' ⑦' in Table 1 show comparative examples, and balls of ①' to ⑤' are arranged so that hardness of cover material is respectively Shore D 56, and under conditions shown in Table 1, the balls of ①' to ⑤' were respectively ground to remove flash. As well as the foregoing case, one hundred balls were ground in each case of ①', to ⑤'.

As described in the foregoing, when the grain size of the grinding face 7 is Japanese Industrial Standard grain size #80 to #300 and the grinding tool 6 and the ball 1 are rotated so that their adjacent points move toward opposite directions at relative velocity of 2500 mm/s to 7500 mm/s, the buffed face is finished beautifully, and moreover, the buffed face is ground uniformly, and it is possible to prevent shavings from melting and sticking to the ball surface.

Relative velocity is arranged between 2500 mm/s and 7500 mm/s because the buffed face is not completely ground as shown in the comparative examples ②' and ③' when relative velocity is less than 2500 mm/s, and the buffed face is ragged as shown in the comparative example of ①' when relative velocity is more than 7500 mm/s. The grain size of the grinding face 7 is arranged to be JIS grain size #80 to #300 because the buffed face is rough as shown in the comparative example of ④' when the grain size is less than #80, and the ball can not be ground and buffed precisely and the external appearance becomes inferior when the grain size is more than #300.

According to the method for manufacturing a golf ball of the present invention, even when soft thermoplastics resin is used as cover material, it is possible to manufacture a golf ball of a superior appearance which is buffed uniformly. When the ball is ground for only 0.3 to 5 seconds, heat rarely occurs and shavings rarely melt, and it is therefore possible to prevent damaging the appearance of the ball. It is possible to accurately prevent ball shavings from melting and sticking to the ball surface by sucking the shavings, and it is possible to stably grind balls for a long term if a diamond grindstone is used as the grinding tool 6.

While preferred embodiments of the present invention have been described in this specification, it is to be understood that the invention is illustrative and not restrictive, because various changes are possible within the spirit and indispensable features.

What is claimed is:

1. A method of removing flash from the parting line on the surface of a golf ball formed of a thermoplastics resin cover material having a hardness of Shore D 40 to 75 comprising the steps of:

securing said golf ball for movement limited to rotation about an axis perpendicular to said parting line;

continuously rotating said golf ball about said axis whereby said surface of said golf ball at said parting line moves at a speed of between 100 and 600 mm/sec;

providing a grinding tool having a grinding face which is substantially parallel to said rotational axis of said ball;

moving said grinding face at a speed of between 2400 and 6900 mm/sec in a direction opposite to the direction of movement of said golf ball parting line resulting from rotation of said golf ball;

moving said grinding tool with respect to said golf ball to place said grinding face of said tool in grinding contact with said parting line, whereby, at a point of contact between the grinding face of said tool and the parting line of said golf ball, said grinding face and said parting line move in opposite directions at a relative velocity of between 2500 mm/sec and 7500 mm/sec; and grinding said flash from said parting line; and providing a sucking pipe having a sucking mouth which opens adjacent the parting line and removing shavings ground from said golf ball surface as said ball is ground.

2. The method as set forth in claim 1 including the further steps of:

providing a rotatable discoid grinding tool having a grinding face substantially parallel to its axis of rotation; and maintaining said axis of rotation of said grinding tool substantially parallel to said axis about which said golf ball is rotated.

* * * * *